US009076408B2

(12) United States Patent
Chen

(10) Patent No.: US 9,076,408 B2
(45) Date of Patent: Jul. 7, 2015

(54) FRAME DATA SHRINKING METHOD USED IN OVER-DRIVING TECHNOLOGY

(75) Inventor: Yu-Yeh Chen, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 161 days.

(21) Appl. No.: 13/697,353

(22) PCT Filed: Sep. 7, 2012

(86) PCT No.: PCT/CN2012/081116

§ 371 (c)(1), (2), (4) Date: Nov. 10, 2012

(87) PCT Pub. No.: WO2014/036719

PCT Pub. Date: Mar. 13, 2014

(65) Prior Publication Data

US 2014/0063032 A1 Mar. 6, 2014

(30) Foreign Application Priority Data

Sep. 6, 2012 (CN) ..... 2012 1 0327306

(51) Int. Cl.
*G09G 5/39* (2006.01)
*G09G 5/393* (2006.01)

(52) U.S. Cl.
CPC ..... *G09G 5/39* (2013.01); *G09G 5/393* (2013.01); *G09G 2320/0247* (2013.01); *G09G 2320/0252* (2013.01); *G09G 2340/02* (2013.01)

(58) Field of Classification Search
USPC ..... 345/545; 382/305
See application file for complete search history.

(56) References Cited

U.S. PATENT DOCUMENTS

| | | | | |
|---|---|---|---|---|
| 8,009,922 | B2 * | 8/2011 | Chiu et al. | 382/233 |
| 8,041,130 | B2 * | 10/2011 | Lee et al. | 382/232 |
| 8,150,203 | B2 * | 4/2012 | Someya et al. | 382/274 |
| 2010/0295872 | A1 * | 11/2010 | Uchida et al. | 345/660 |

OTHER PUBLICATIONS

Rafael C. Gonzalez and Richard E. Woods, Digital Image Processing, Pearson Education Inc. Third Edition, pp. 68,104, 153.*

* cited by examiner

*Primary Examiner* — Samir Ahmed
*Assistant Examiner* — Menatoallah Youssef

(57) ABSTRACT

A frame data shrinking method is disclosed. The method is to divide frame data into data of target pixel and neighbor pixels, and select one data combination set from a plurality of data combination sets provided from the data neighbor pixels as encoded data of the target pixel; and the data combination set are to be compressed and recovered as decoded data of the target pixel of the current frame for being used to be compared with the decoded data of a target pixel of a previous frame; and then the data of the neighbor pixels are compressed and stored along with the selection information about the target pixel in a memory. Because the usage of memory is relatively lower, the cost of driving chips can be effectively reduced.

7 Claims, 5 Drawing Sheets

FRAME DATA SHRINKING METHOD USED IN OVER-DRIVING TECHNOLOGY

BACKGROUND OF THE INVENTION

1. Field of the Invention

The present invention relates to liquid crystal display technology, especially to a frame data shrinking method used in over-driving technology that effectively shrinks memory usage of over-driving technology.

2. Description of the Related Art

Liquid crystal molecules generally have a limited speed on reacting to the voltage difference of signals. Hence, when a traditional liquid crystal display device displays dynamic images, if the present frame cannot quickly switch to next frame, ghosting effect will occur. In order to solve the problem, an over driving technology is used to apply a voltage which is relatively higher (or lower) than the grey scale data voltage of the next frame in a brief time so as to speed up the reaction of the liquid crystal molecules.

The over driving technology used by current liquid crystal display device requires extra memory to store a previous frame data so that the present frame data can be compared with the previous frame data to determine whether the current image is a static or a dynamic image, and if it is a dynamic image, then the over driving technology will be executed. However, this extra memory will lead to the increase of the cost of driving chips. Therefore, if the amount of the frame data to be pre-stored can be effectively reduced, the cost of driving chips thereby can be reduced.

Therefore, it is necessary to provide a frame data shrinking method used in over-driving technology to overcome the problems existing in the conventional technology.

SUMMARY OF THE INVENTION

In view of the shortcomings of the conventional technology, the main objective of the invention is to provide a frame data shrinking method used in over-driving technology, the method is to perform encoding of a certain pixel by selecting one of the combinations of the data of neighbor pixels which are neighbor to this certain pixel and use this combination of data as the encode data of a certain pixel so that the memory for storing frame data can be effectively reduced.

In order to achieve the foregoing object of the present invention, the present invention provides a frame data shrinking method used in over-driving technology which comprises steps of:

S01: receiving the frame data of a first frame;

S02: dividing the frame data of the first frame into data of a target pixel and data of a plurality of neighbor pixels which are neighbor to the target pixel;

S03: selecting a data combination set which value is close to the data of the target pixel as encoded data of the target pixel from a plurality of data combination sets which are provided by the data of the neighbor pixels in the frame data of the first frame;

S04: compressing the selected data combination set of the frame data of the first frame and recovering the selected data combination set as decoded data of the target pixel of the first frame; and

S05: compressing the data of the neighbor pixels of the frame data of the first frame and storing the compressed data of the neighbor pixels along with the selection information about the target pixel in a memory.

In one embodiment of the present invention, the frame data shrinking method further comprises steps of:

S06: continuing to receive the frame data of a second frame;

S07: dividing the frame data of the second frame into data of a target pixel and data of a plurality of neighbor pixels;

S08: selecting a data combination set which value is close to the data of the target pixel as encoded data of the target pixel from a plurality of data combination sets which are provided by the data of the neighbor pixels in the frame data of the second frame;

S09: compressing the selected data combination set of the frame data of the second frame and recovering the selected data combination set as decoded data of the target pixel of the second frame;

S10: reading the compressed data of the neighbor pixels of the frame data of the first frame which are previously stored in the memory;

S11: uncompressing the compressed data of the neighbor pixels of the frame data of the first frame to decoded data of the neighbor pixels of the first frame;

S12: recovering the decoded data of the target pixel of the first frame from the decoded data of the neighbor pixels of the first frame according to the selection information about the target pixel of the first frame; and

S13: comparing the decoded data of the target pixel of the second frame with the decoded data of the target pixel of the first frame, if both are the same, then directly outputting the original data of the target pixel of the second frame; otherwise, performing over-driving operation for the target pixel.

In one embodiment of the present invention, the frame data shrinking method further comprises steps of:

S14: compressing the data of the neighbor pixels of the frame data of the second frame and recovering the data as decoded data of the neighbor pixels of the second frame; and

S15: comparing the decoded data of the neighbor pixels of the second frame and the decoded data of the neighbor pixels of the first frame, if both are the same, then directly outputting the original data of the neighbor pixels of the frame data of the second frame; otherwise, performing an over-driving operation for the neighbor pixels.

In one embodiment of the present invention, in the step S02, the frame data of the first frame are divided into the data of the target pixel and the data of the neighbor pixels according to predetermined reference information of rows and columns.

In one embodiment of the present invention, the neighbor pixels of the frame data of the first frame are eight pixels which are neighbor to the target pixel; wherein in an order of left-top, top, right-top, right, right-bottom, bottom, left-bottom and left, the eight pixels are respectively labeled with 1 to 8; and the plurality of data combination sets provided by the eight neighbor pixels D(1), D(2) . . . D(8), Avg(1~8), Avg(2,6,4,8), Avg(4,8), Avg(2,6), Avg(1,5), Avg(3,7), Avg(1,2,3), Avg(3,4,5), Avg(5,6,7) and Avg(7,8,1), wherein D(1), D(2) . . . and D(8) respectively represent the gray scale value of each of the neighbor pixels; Avg(1~8) represents the average of D(1), D(2) . . . and D(8); Avg(2,6,4,8) represents the average of D(2), D(4), D(6) and D(8); Avg(4,8) represents the average of D(4) and D(8); Avg(2,6) represents the average of D(2) and D(6); Avg(1,5) represents the average of D(1) and D(5); Avg(3,7) represents the average of D(3) and D(7); Avg(1,2,3) represents the average of D(1), D(2) and D(3); Avg(3,4,5) represents the average of D(3), D(4) and D(5); Avg(5,6,7) represents the average of D(5), D(6) and D(7); and Avg(7,8,1) represents the average of D(7), D(8) and D(1).

In one embodiment of the present invention, the plurality of data combination sets provided by the eight neighbor pixels further include F(4,8), F(2,6), F(1,5), F(3,7), wherein F(x,y)

$=\frac{1}{3}*D(x)+\frac{2}{3}*D(y)$; or $F(x,y)=\frac{2}{3}*D(x)+\frac{1}{3}*D(y)$, x and y represent the number of the neighbor pixel.

An embodiment of the present invention further provides a frame data shrinking method used in over-driving technology comprising steps of:

S01: receiving the frame data of a first frame;

S02: dividing the frame data of the first frame into data of a target pixel and data of a plurality of neighbor pixels which are neighbor to the target pixel, wherein the frame data of the first frame are divided into the data of the target pixel and the data of the neighbor pixels according to predetermined reference information of rows and columns;

S03: selecting a data combination set which value is close to the data of the target pixel as encoded data of the target pixel from a plurality of data combination sets which are provided by the data of the neighbor pixels in the frame data of the first frame;

S04: compressing the selected data combination set of the frame data of the first frame and recovering the selected data combination set as decoded data of the target pixel of the first frame;

S05: compressing the data of the neighbor pixels of the frame data of the first frame and storing the compressed data of the neighbor pixels along with the selection information about the target pixel in a memory;

S06: continuing to receive the frame data of a second frame;

S07: dividing the frame data of the second frame into data of a target pixel and data of a plurality of neighbor pixels;

S08: selecting a data combination set which value is close to the data of the target pixel as encoded data of the target pixel from a plurality of data combination sets which are provided by the data of the neighbor pixels in the frame data of the second frame;

S09: compressing the selected data combination set of the frame data of the second frame and recovering the selected data combination set as decoded data of the target pixel of the second frame;

S10: reading the compressed data of the neighbor pixels of the frame data of the first frame which are previously stored in the memory;

S11: uncompressing the compressed data of the neighbor pixels of the frame data of the first frame to decoded data of the neighbor pixels of the first frame;

S12: recovering the decoded data of the target pixel of the first frame from the decoded data of the neighbor pixels of the first frame according to the selection information about the target pixel of the first frame; and

S13: comparing the decoded data of the target pixel of the second frame with the decoded data of the target pixel of the first frame, if both are the same, then directly outputting the original data of the target pixel of the second frame; otherwise, performing over-driving operation for the target pixel.

The present invention is to divide frame data into data of target pixel and neighbor pixels, and select one data combination set from a plurality of data combination sets provided from the data neighbor pixels as encoded data of the target pixel; the data of the neighbor pixels will be compressed and then stored along with the selection information about the target pixel in a memory. When receiving frame data of next frame, the data of the neighbor pixels of the previous frame will be read from the memory to recover the target pixel's data according to the selection information so that the data of the target pixel of previous frame can be used to be compared with the encoded data of the target pixel of the next frame so as to determine whether to perform over-driving algorithm. Because the usage of memory is relatively lower, the cost of driving chips can be effectively reduced.

DETAILED DESCRIPTION OF THE PREFERRED EMBODIMENTS

The foregoing objects, features and advantages adopted by the present invention can be best understood by referring to the following detailed description of the preferred embodiments and the accompanying drawings. Furthermore, the directional terms described in the present invention, such as upper, lower, front, rear, left, right, inner, outer, side and etc., are only directions referring to the accompanying drawings, so that the used directional terms are used to describe and understand the present invention, but the present invention is not limited thereto.

Figure 1A:
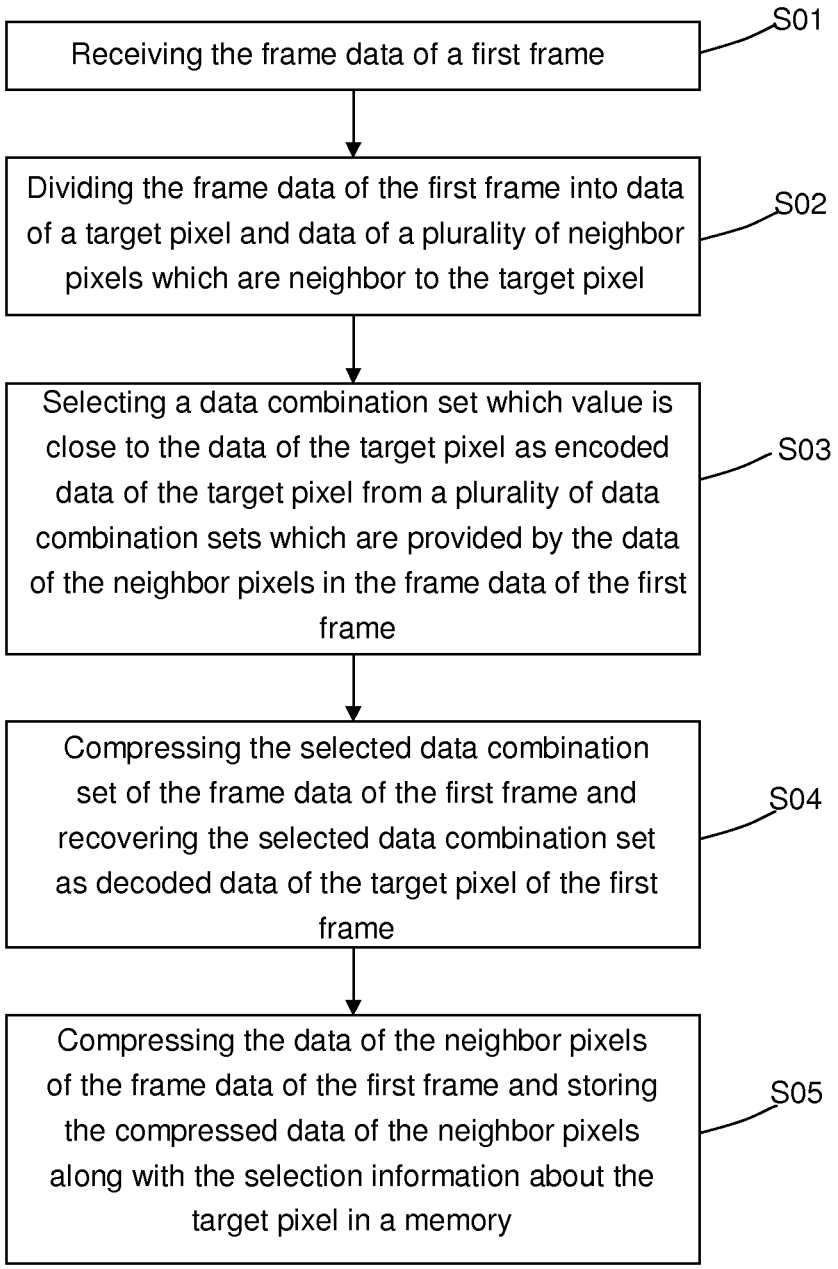
FIGS. 1A to 1C are flow charts of a frame data shrinking method according to a preferred embodiment of the present invention.
Figure 1B:
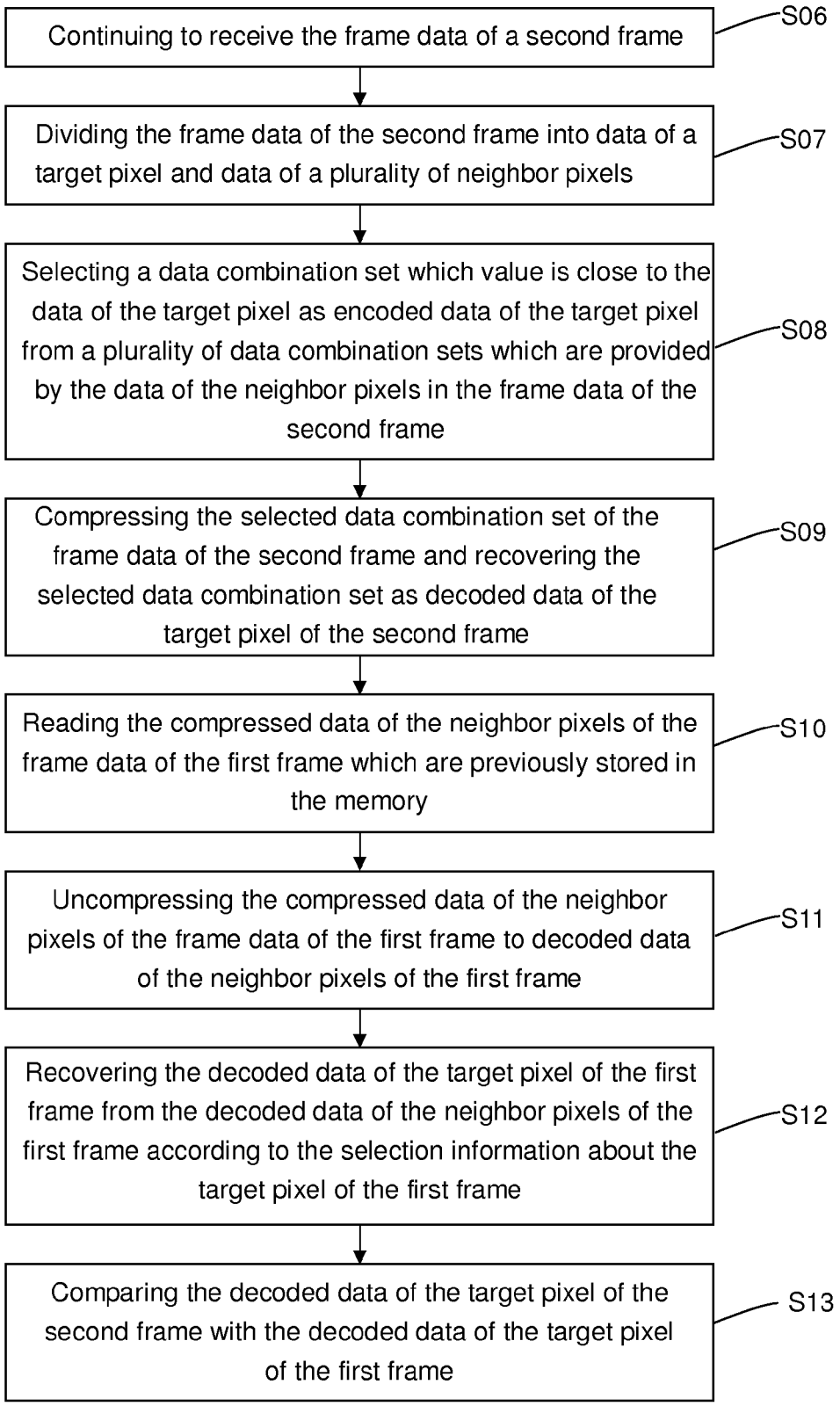
Figure 1C:
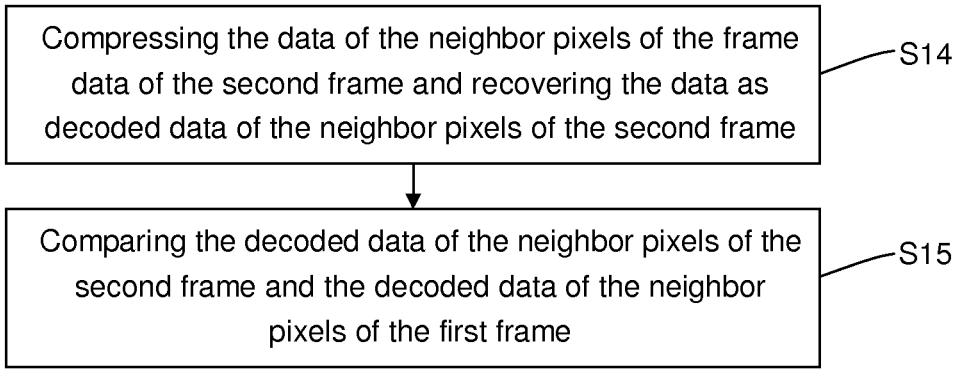
Figure 2:
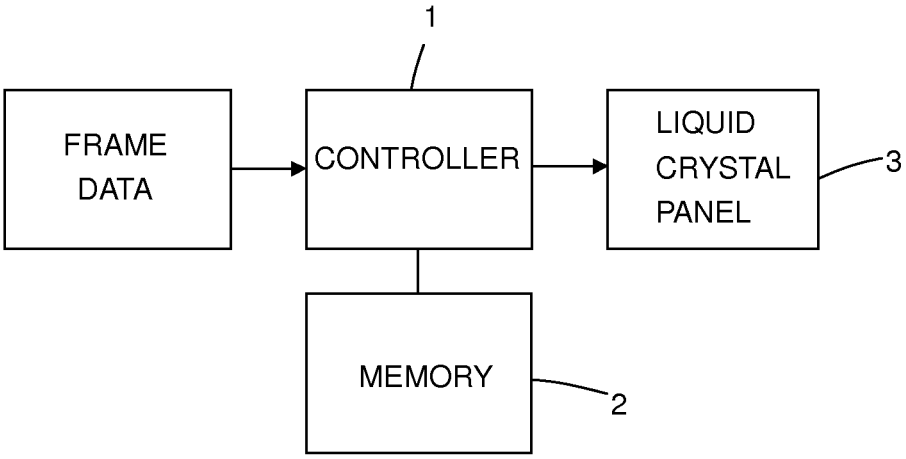
FIG. 2 is a schematic block diagram of an apparatus for executing the frame data shrinking method of the present invention.

With reference to FIGS. 1A-1C and 2, FIGS. 1A-1C are schematic views of the process of a frame data shrinking method used in over-driving technology according to a preferred embodiment of the present invention; and FIG. 2 is a schematic block diagram of an apparatus executing the frame data shrinking method of the present invention. The frame data shrinking method is mainly executed by a controller 1 and a memory 2. The controller 1 and the memory 2 may be integrated in an over-driving circuit that is constructed with a time schedule controller (TCON). The time schedule controller can receive a frame data, and accordingly control a gate driving circuit of a liquid crystal panel 3 to orderly switch on the pixel rows of the liquid crystal panel and then output pixel information of the frame data to a data driving circuit of the liquid crystal panel to activate pixel display of each of the pixel rows. During the process of continuously receiving the frame data, the controller 1 will execute the aforementioned frame data shrinking method to compress the frame data of the previous frame (for example, n frame) and store the frame data in the memory 2; and when receiving another frame data of next frame (for example, n+1 frame), the controller 1 will read and recover the stored frame data (the frame data of the n frame that has been compressed and stored in the memory), and then compare the recovered frame data of the previous frame (n frame) with the present frame data of the current frame (n+1 frame) which is also being compressed and immediately recovered, so as to determine whether the current status is to output a static image or a dynamic image; and if the current status is to output a dynamic image, then an over-driving circuit is further used to execute a over-driving algorithm, so as to speed up the reaction of the liquid crystal molecules to prevent a ghosting phenomenon.

With reference to FIG. 1A, for the frame data of one frame which are currently received, the frame data shrinking method executed by the controller 1 comprises following steps:

S01: receiving the frame data of a first frame;

S02: dividing the frame data of the first frame into data of a target pixel and data of a plurality of neighbor pixels which are neighbor to the target pixel;

S03: selecting a data combination set which value is close to the data of the target pixel as encoded data of the target pixel from a plurality of data combination sets which are provided by the data of the neighbor pixels in the frame data of the first frame;

S04: compressing the selected data combination set of the frame data of the first frame and recovering the selected data combination set as decoded data of the target pixel of the first frame; and S05: compressing the data of the neighbor pixels of the frame data of the first frame and storing the compressed data of the neighbor pixels along with the selection information about the target pixel in a memory.

In the foregoing step S02, the frame data of the first frame are divided into data of a target pixel and data of a plurality of neighbor pixels which are neighbor to the target pixel according to predetermined reference information of rows and columns. For example, in a row of pixels, the pixels which are in odd columns are defined as target pixels, in the next row of pixel, the pixels which are in even columns are defined as target pixels.

In the foregoing step S03, the plurality of data combination sets provided by the data of the neighbor pixels of frame data of the first frame may include the gray scale value of each of the neighbor pixels or the average of the gray scale values of some of the neighbor pixels.

Figure 3:
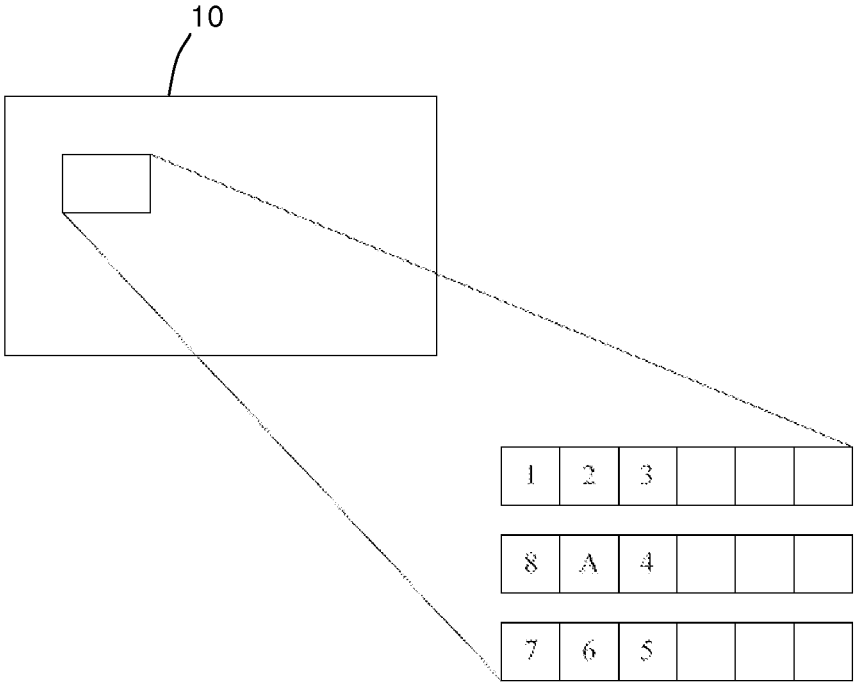
FIG. 3 is a schematic view of the data information of a frame in a part of a pixel area.

For example, with further reference to FIG. 3, FIG. 3 is a schematic view of the frame data in a part of a pixel area. The target pixel of the frame data is labeled with A, and the neighbor pixels are eight pixels which are neighbor to the target pixel A. In an order of left-top, top, right-top, right, right-bottom, bottom, left-bottom and left, the eight pixels are respectively labeled with 1 to 8. In one embodiment, the plurality of data combination sets provided by the eight neighbor pixels preferably include: D(1), D(2) . . . D(8), Avg(1~8), Avg(2,6,4,8), Avg(4,8), Avg(2,6), Avg(1,5), Avg(3,7), Avg(1,2,3), Avg(3,4,5), Avg(5,6,7) and Avg(7,8,1), wherein D(1), D(2) . . . and D(8) respectively represent the gray scale value of each of the neighbor pixels; Avg(1~8) represents the average of D(1), D(2) . . . and D(8); Avg(2,6,4,8) represents the average of D(2), D(4), D(6) and D(8); likewise, Avg(4,8) represents the average of D(4) and D(8); Avg(2,6) represents the average of D(2) and D(6); Avg(1,5) represents the average of D(1) and D(5); Avg(3,7) represents the average of D(3) and D(7); Avg(1,2,3) represents the average of D(1), D(2) and D(3); Avg(3,4,5) represents the average of D(3), D(4) and D(5); Avg(5,6,7) represents the average of D(5), D(6) and D(7); and Avg(7,8,1) represents the average of D(7), D(8) and D(1).

The plurality of data combination sets provided by the data of the neighbor pixels in the frame data of the first frame may further include the weighted average of the gray values of some of the neighbor pixels. For example, the plurality of data combination sets provided by the foregoing eight neighbor pixels may further include: F(4,8), F(2,6), F(1,5), F(3,7), wherein $F(x,y)=\frac{1}{3}*D(x)+\frac{2}{3}*D(y)$; or $F(x,y)=\frac{2}{3}*D(x)+\frac{1}{3}*D(y)$, x and y represent the number of the neighbor pixel.

In the plurality of data combination sets, the data combination set which value is close to the data of the target pixel A will be selected as encoded data of the target pixel A.

In the step S04, the selected data combination set will be compressed and then immediately uncompressed to be recovered as decoded data of the target pixel of the frame data of the first frame. Since the data combination set constituted by the data of the neighbor pixels are compressed and stored in the memory 2, when the data combination set are uncompressed later for reading, a certain degree of distortion will occur, therefore, step S04 is mainly to provide a decoded pixel having the same condition of distortion for performing a more accurate comparison of the previous frame data and the current frame data by compressing and then uncompressing the originally selected data combination set so that the accuracy of data comparison can be enhanced.

In the step S05, the data of the neighbor pixels of the frame data of the first frame will be compressed and then stored along with the selection information about the target pixel in the memory 2.

The data of the neighbor pixels can be linearly or non-linearly converted to a fixed corresponding value. Since the amount of this corresponding value is relatively smaller than the amount of the original data, a compression effect can be achieved. The conversion method can be implemented by converting the pixel values in RGB format into pixel values in YCbCr format and then taking the most significant bit (MSB) of the pixel values; or by performing color conversion to the pixel values in RGB format based on a lookup table of colors; or by directly taking the most significant bit (MSB) of the pixel values in RGB format; or by performing color conversion to the pixel values in RGB format based on a lookup table of colors and then taking the most significant bit (MSB) of the pixel values.

With reference FIG. 1B, after storing the frame data of one frame, the frame data shrinking method executed by the controller 1 may further include following steps:

S06: continuing to receive the frame data of a second frame;

S07: dividing the frame data of the second frame into data of a target pixel and data of a plurality of neighbor pixels;

S08: selecting a data combination set which value is close to the data of the target pixel as encoded data of the target pixel from a plurality of data combination sets which are provided by the data of the neighbor pixels in the frame data of the second frame;

S09: compressing the selected data combination set of the frame data of the second frame and recovering the selected data combination set as decoded data of the target pixel of the second frame;

S10: reading the compressed data of the neighbor pixels of the frame data of the first frame which are previously stored in the memory;

S11: uncompressing the compressed data of the neighbor pixels of the frame data of the first frame to decoded data of the neighbor pixels of the first frame;

S12: recovering the decoded data of the target pixel of the first frame from the decoded data of the neighbor pixels of the first frame according to the selection information about the target pixel of the first frame; and S13: comparing the decoded data of the target pixel of the second frame with the decoded data of the target pixel of the first frame, if both are the same, then directly outputting the original data of the target pixel of the second frame; otherwise, performing over-driving operation for the target pixel.

In the step S06, the frame data of the first frame have become the previous frame data and stored in the memory 2 through steps S01 to S05, and the frame data of the second frame become the current frame data.

Being the same as steps S02 to S04, in the steps S07 to S09, the frame data of the second frame are divided into data of a target pixel and data of a plurality of neighbor pixels, and a data combination set which value is close to the data of the target pixel is selected as encoded data of the target pixel from a plurality of data combination sets provided by the data of the neighbor pixels, and then the selected data combination set is compressed and immediately recovered as decoded data of the target pixel of the second frame.

At the same time, in steps S10 and S11, the data of the neighbor pixels of the frame data of the first frame that are previously stored in the memory 2 are read and then uncompressed to be recovered as decoded data of the neighbor pixels of the frame data of the first frame.

As described in step S12, the decoded data of the target pixel of the frame data of the first frame are recovered from the data of the decoded neighbor pixels of the frame data of the first frame according to the selection information about the target pixel of the first frame.

As described in the step S013, the current decoded data of the target pixel of the second frame can be compared with the previous decoded data of the target pixel of the first frame under the same distortion condition. If the comparison shows both are the same, which means the current target pixel is displaying a static image, and the original gray scale data of the target pixel of the frame data of the second frame can be directly outputted. Otherwise, if both are different, which means the current target pixel is displaying a dynamic image, an over-driving operation will have to be performed for the target pixel so as to speed up the reaction of liquid crystal molecules to prevent image ghosting.

Furthermore, as shown in FIG. 1C, the frame data shrinking method executed by the controller 1 may further include following steps:

S14: compressing the data of the neighbor pixels of the frame data of the second frame and recovering the data as decoded data of the neighbor pixels of the second frame;

S15: comparing the decoded data of the neighbor pixels of the second frame and the decoded data of the neighbor pixels of the first frame, if both are the same, then directly outputting the original data of the neighbor pixels of the frame data of the second frame; otherwise, performing an over-driving operation for the neighbor pixels.

The current data of the neighbor pixels of the frame data of the second frame also have to be stored in the memory 2 after being compressed so that the data can be used for next comparison with the frame data of next frame. However, being the same as the data comparison for the target pixel, in the steps S14 and S15, the data of the neighbor pixels of the second frame will be uncompressed again to be recovered as the decoded data of the neighbor pixels of the second frame so as to be used for being compared with the decoded data of the neighbor pixels of the first frame. Therefore, the current decoded data of the neighbor pixels of the second frame can be compared with the previous decoded data of the neighbor pixels of the first frame under the same distortion condition. If the comparison shows both are the same, which means the current neighbor pixels are displaying a static image, and the original gray scale data of the neighbor pixels of the frame data of the second frame can be directly outputted. Otherwise, if both are different, which means the current neighbor pixels are displaying a dynamic image, an over-driving operation will have to be performed for the neighbor pixels so as to speed up the reaction of liquid crystal molecules to prevent image ghosting.

By the above description, the present invention is to divide frame data into data of target pixel and neighbor pixels, and select one data combination set from a plurality of data combination sets provided from the data neighbor pixels as encoded data of the target pixel; the data of the neighbor pixels will be compressed and then stored along with the selection information about the target pixel in a memory. When receiving the frame data of next frame, the data of the neighbor pixels of the previous frame will be read from the memory to recover the target pixel's data according to the selection information so that the data of the target pixel of previous frame can be used to be compared with the encoded data of the target pixel of the next frame so as to determine whether to perform over-driving algorithm. This frame data shrinking method can effectively reduce the usage of memory and a condition of image flicking will not occur during the operation. Because the calculation of the data combination set of the neighbor pixels is simple, it effectively reduces the amount of logic gates that are used in a time schedule controller of a liquid crystal display device and thereby reducing the cost of driving chips.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A frame data shrinking method used in over-driving technology comprising steps of:

S01: receiving the frame data of a first frame;

S02: dividing the frame data of the first frame into data of a target pixel and data of a plurality of neighbor pixels which are neighbor to the target pixel, wherein the frame data of the first frame are divided into the data of the target pixel and the data of the neighbor pixels according to predetermined reference information of rows and columns;

S03: selecting a data combination set which value is close to the data of the target pixel as encoded data of the target pixel from a plurality of data combination sets which are provided by the data of the neighbor pixels in the frame data of the first frame;

S04: compressing the selected data combination set of the frame data of the first frame and decompressing the selected data combination set as decoded data of the target pixel of the first frame;

S05: compressing the data of the neighbor pixels of the frame data of the first frame and storing the compressed data of the neighbor pixels along with the selection information about the target pixel in a memory;

S06: continuing to receive the frame data of a second frame;

S07: dividing the frame data of the second frame into data of a target pixel and data of a plurality of neighbor pixels;

S08: selecting a data combination set which value is close to the data of the target pixel as encoded data of the target pixel from a plurality of data combination sets which are provided by the data of the neighbor pixels in the frame data of the second frame;

S09: compressing the selected data combination set of the frame data of the second frame and decompressing the selected data combination set as decoded data of the target pixel of the second frame;

S10: reading the compressed data of the neighbor pixels of the frame data of the first frame which are previously stored in the memory;

S11: decompressing the compressed data of the neighbor pixels of the frame data of the first frame to decoded data of the neighbor pixels of the first frame;

S12: recovering the decoded data of the target pixel of the first frame from the decoded data of the neighbor pixels of the first frame according to the selection information about the target pixel of the first frame; and S13: comparing the decoded data of the target pixel of the second frame with the decoded data of the target pixel of the first frame, if both are the same, then directly outputting the original data of the target pixel of the second frame; otherwise, performing over-driving operation for the target pixel.

2. The frame data shrinking method as claimed in claim 1, wherein the neighbor pixels of the frame data of the first frame are eight pixels which are neighbor to the target pixel; wherein in an order of left-top, top, right-top, right, right-bottom, bottom, left-bottom and left, the eight pixels are respectively labeled with 1 to 8; and the plurality of data combination sets provided by the eight neighbor pixels D(1), D(2) . . . D(8), Avg(1~8), Avg(2,6,4,8), Avg(4,8), Avg(2,6), Avg(1,5), Avg (3,7), Avg(1,2,3), Avg(3,4,5), Avg(5,6,7) and Avg(7,8,1), wherein D(1), D(2) . . . and D(8) respectively represent the gray scale value of each of the neighbor pixels; Avg(1~8) represents the average of D(1), D(2). . . and D(8); Avg(2,6,4,8) represents the average of D(2), D(4), D(6) and D(8); Avg(4,8) represents the average of D(4) and D(8); Avg (2,6) represents the average of D(2) and D(6); Avg(1,5) represents the average of D(1) and D(5); Avg(3,7) represents the average of D(3) and D(7); Avg(1,2,3) represents the average of D(1), D(2) and D(3); Avg(3,4,5) represents the average of D(3), D(4) and D(5); Avg(5,6,7) represents the average of D(5), D(6) and D(7); and Avg(7,8,1) represents the average of D(7), D(8) and D(1).

3. The frame data shrinking method as claimed in claim 2, wherein the plurality of data combination sets provided by the eight neighbor pixels further include F(4,8), F(2,6), F(1,5), F(3,7), wherein $F(x,y)=\frac{1}{3}*D(x)+\frac{2}{3}*D(y)$; or $F(x,y)=\frac{2}{3}*D(x)+\frac{1}{3}*D(y)$, x and y represent the number of the neighbor pixel.

4. A frame data shrinking method used in over-driving technology comprising steps of:

S01: receiving the frame data of a first frame;

S02: dividing the frame data of the first frame into data of a target pixel and data of a plurality of neighbor pixels which are neighbor to the target pixel;

S03: selecting a data combination set which value is close to the data of the target pixel as encoded data of the target pixel from a plurality of data combination sets which are provided by the data of the neighbor pixels in the frame data of the first frame;

S04: compressing the selected data combination set of the frame data of the first frame and decompressing the selected data combination set as decoded data of the target pixel of the first frame;

S05: compressing the data of the neighbor pixels of the frame data of the first frame and storing the compressed data of the neighbor pixels along with the selection information about the target pixel in a memory;

S06: continuing to receive the frame data of a second frame;

S07: dividing the frame data of the second frame into data of a target pixel and data of a plurality of neighbor pixels;

S08: selecting a data combination set which value is close to the data of the target pixel as encoded data of the target pixel from a plurality of data combination sets which are provided by the data of the neighbor pixels in the frame data of the second frame;

S09: compressing the selected data combination set of the frame data of the second frame and decompressing the selected data combination set as decoded data of the target pixel of the second frame;

S10: reading the compressed data of the neighbor pixels of the frame data of the first frame which are previously stored in the memory;

S11: decompressing the compressed data of the neighbor pixels of the frame data of the first frame to decoded data of the neighbor pixels of the first frame;

S12: recovering the decoded data of the target pixel of the first frame from the decoded data of the neighbor pixels of the first frame according to the selection information about the target pixel of the first frame;

S13: comparing the decoded data of the target pixel of the second frame with the decoded data of the target pixel of the first frame, if both are the same, then directly outputting the original data of the target pixel of the second frame; otherwise, performing over-driving operation for the target pixel;

S14: compressing the data of the neighbor pixels of the frame data of the second frame and decompressing the data as decoded data of the neighbor pixels of the second frame; and S15: comparing the decoded data of the neighbor pixels of the second frame and the decoded data of the neighbor pixels of the first frame, if both are the same, then directly outputting the original data of the neighbor pixels of the frame data of the second frame; otherwise, performing an over-driving operation for the neighbor pixels.

5. The frame data shrinking method as claimed in claim 4, wherein in the step S02, the frame data of the first frame are divided into the data of the target pixel and the data of the neighbor pixels according to predetermined reference information of rows and columns

6. The frame data shrinking method as claimed in claim 4, wherein the neighbor pixels of the frame data of the first frame are eight pixels which are neighbor to the target pixel; wherein in an order of left-top, top, right-top, right, right-bottom, bottom, left-bottom and left, the eight pixels are respectively labeled with 1 to 8; and the plurality of data combination sets provided by the eight neighbor pixels D(1), D(2) . . . D(8), Avg(1~8), Avg(2,6,4,8), Avg(4,8), Avg(2,6), Avg(1,5), Avg (3,7), Avg(1,2,3), Avg(3,4,5), Avg(5,6,7) and Avg(7,8,1), wherein D(1), D(2) . . . and D(8) respectively represent the gray scale value of each of the neighbor pixels; Avg(1~8) represents the average of D(1), D(2) . . . and D(8); Avg(2,6,4,8) represents the average of D(2), D(4), D(6) and D(8); Avg(4,8) represents the average of D(4) and D(8); Avg (2,6) represents the average of D(2) and D(6); Avg(1,5) represents the average of D(1) and D(5); Avg(3,7) represents the average of D(3) and D(7); Avg(1,2,3) represents the average of D(1), D(2) and D(3); Avg(3,4,5) represents the average of D(3), D(4) and D(5); Avg(5,6,7) represents the average of D(5), D(6) and D(7); and Avg(7,8,1) represents the average of D(7), D(8) and D(1).

7. The frame data shrinking method as claimed in claim 6, wherein the plurality of data combination sets provided by the eight neighbor pixels further include F(4,8), F(2,6), F(1,5), F(3,7), wherein $F(x,y)=\frac{1}{3}*D(x)+\frac{2}{3}*D(y)$; or $F(x,y)=\frac{2}{3}*D(x)+\frac{1}{3}*D(y)$, x and y represent the number of the neighbor pixel.

* * * * *